United States Patent [19]

Hutzenlaub et al.

[11] Patent Number: 5,022,598

[45] Date of Patent: Jun. 11, 1991

[54] ROLL-HANDLING MACHINE FOR WEB MATERIAL

[75] Inventors: Armin Hutzenlaub, Wiehl; Burkhard Kaul, Erkrath, both of Fed. Rep. of Germany

[73] Assignee: Kampf GmbH & Co. Maschinenfabrik, Wiehl, Fed. Rep. of Germany

[21] Appl. No.: 463,024

[22] Filed: Jan. 10, 1990

[51] Int. Cl.[5] ..... B65H 16/06; B65H 19/12

[52] U.S. Cl. ..... 242/68.4; 242/58.6

[58] Field of Search ..... 242/68.4, 58, 58.6, 242/79, 129.51, 129.53

[56] References Cited

U.S. PATENT DOCUMENTS 2,501,985 3/1950 Benjamin ..... 242/58

3,057,571 10/1962 Aaron et al. ..... 242/68.4

4,265,411 5/1981 Fasolak ..... 242/68.4 X

*Primary Examiner*—John M. Jillions

*Attorney, Agent, or Firm*—Herbert Dubno

[57] ABSTRACT

A roll-winding machine for winding rolls of a web material, especially for use in a clean room, has a traverse extending the full operating width and provided with a plurality of slides whose arms hold the rolls to be wound. The slides have legs which pass through slits formed in an enclosure constituted by cover plates and/or the traverse walls so that the enclosure completely surrounds the guide surfaces of the slide feet on the rails of the traverse, leaving free only the minimal slits through which the legs pass. As a consequence, the release of contaminants into the surrounding space is greatly reduced.

15 Claims, 1 Drawing Sheet

FIG. 1
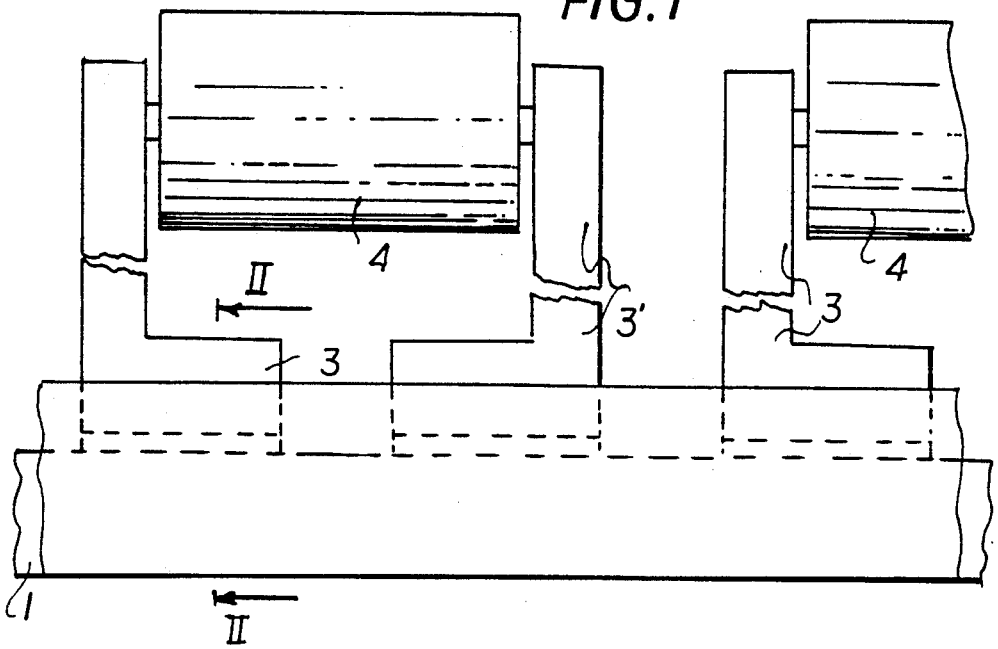
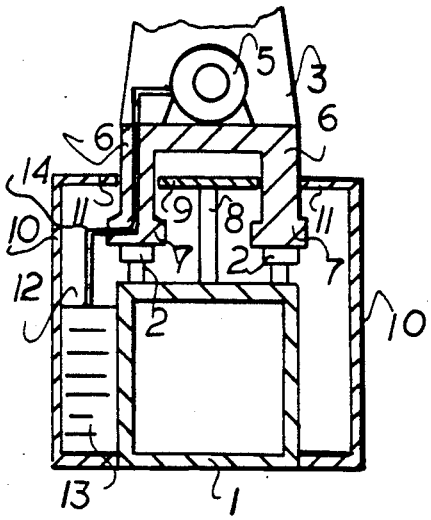
FIG. 2
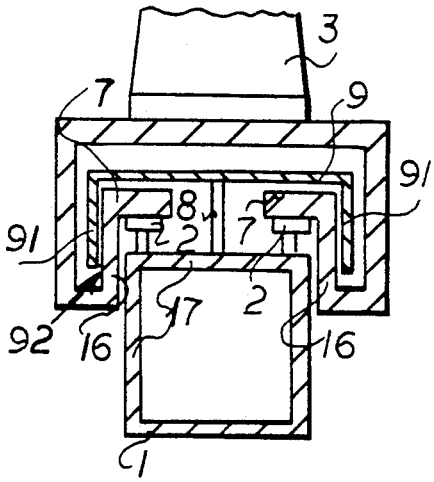
FIG. 3
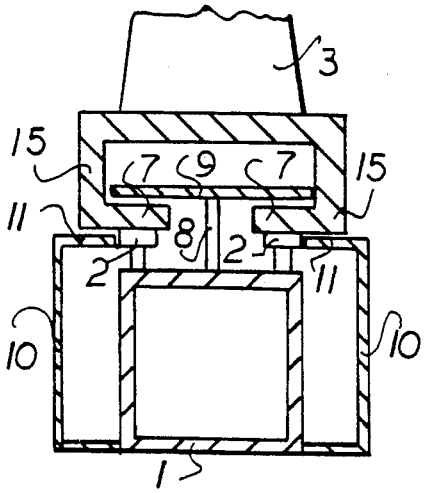
FIG. 4

ROLL-HANDLING MACHINE FOR WEB MATERIAL

FIELD OF THE INVENTION

Our present invention relates to a roll-handling machine for web material and, more particularly, to a winding machine for the formation of individual rolls of respective webs.

BACKGROUND OF THE INVENTION

Machines used for the handling of web materials frequently require the formation of a plurality of individual rolls of respective webs, e.g. tapes, bands or strips, on respective cores in spaced relationship along a traverse which extends generally transversely to the feed direction of the web.

Typical of such machines is a roll winding machine for the formation of individual rolls from respective web portions which may be formed from a wider web by longitudinal slitting. In such machines the traverse can comprise a guide, e.g. formed by a pair of rails, and each of the individual rolls during the winding thereof may be supported in a pair of winding arms projecting from respective slides having feet which ride along these rails.

In the known roll-winding machines of this type, see for example U.S. Pat. No. 2,501,985, the rails and the feet which engage them, i.e. the guide regions, are free or open to the environment.

These guide portions require lubrication with a lubricant or some other antifriction agent for reliable operation. These materials produce contaminants in operation. In addition, there is a certain degree of wear of the relatively moving parts of the guide region which, although slight, produces additional debris and impurities.

Such impurities resulting from the sliding movements cannot be tolerated in the production of sensitive tapes, especially magnetic tapes and thus such apparatus cannot be employed when clean-room requirements must be fulfilled.

It is known to provide bellows type and telescoping-plate enclosures to prevent the incursion of such contaminants into the surrounding space. However, because the limited space availability and the limitations that the bellows and telescoping-plate arrangements provide for the cut width of the tapes, these approaches have not been found to be practical for magnetic-tape production in many instances.

OBJECTS OF THE INVENTION

It is, therefore, an important object of the present invention to provide a roll-winding machine capable of winding up a plurality of rolls of respective web materials, e.g. magnetic tapes, whereby the drawbacks of the aforedescribed systems are avoided.

Another object of this invention is to provide an improved roll-winding apparatus having sliding guide means which completely excludes any problems from impurities or contaminants arising from the guide surfaces.

Another object of the invention is to provide an improved apparatus of the class described which can be used effectively in a clean room and for the production of magnetic tape without the drawbacks of earlier systems.

Still another object of my invention is to provide a roll-winding apparatus which is free from the limitations of earlier apparatus with respect to the cut width of the magnetic tapes which can be made.

SUMMARY OF THE INVENTION

These objects and others which will become apparent hereinafter are attained, in accordance with the present invention by providing each of the sliding feet of the slide carrying a roll winding arm with a leg which extends through a slit formed by cover plates and/or the traverse walls.

More specifically a roll-winding machine of the invention can comprise:

- a traverse;
- a pair of rectilinear guides formed on the traverse;
- a pair of coil-receiving arms mounted on the guides and receiving a coil of the web between them, the arms each having a coil slide shiftable along the traverse, each of the slides being formed with a respective sliding foot riding on each of the rails and a respective leg formed with each of the feet extending away from the respective foot; and
- enclosure means extending along the traverse at least around the guides, receiving the feet and at least partly defining slots extending along the guides through which the feet pass for limiting release of contaminants from regions of engagement of the feet with the guides.

The invention thus differs from the state of the art discussed above in that the guide elements, i.e. the rails and the guide feet, are substantially completely covered so that at each guide path only a small slit remains free through which the legs of the slide bodies can pass. These small slits constitute minimal slits since a complete covering of the slide path is not possible. The exposed surface is significantly reduced while the movement and adjustability of the slides is not in any way hindered so that very small cut widths of the tapes can be produced. 10 Furthermore, the slits are located at some distance from the guide surfaces, further reducing the possibility that contaminants, dust particles, vapor particles or the like can escape. An especially simple configuration of the slide feet, according to the invention, provides the slide feet and the slide with a generally U-shaped cross section, while between two guide rails a support is provided on the traverse with a cover plate which substantially fills the distance between the legs. Along the outer sides of the legs a cover plate is provided which, in turn, is connected with and closed against the traverse.

In a simpler configuration of the legs, the latter extend vertically and the plane of the slits is substantially horizontal.

If one wishes to reduce the possibility that contaminants will pass out of the enclosure still further, the legs can be provided, in accordance with the invention, in an offset configuration with segments which extend horizontally. In that case, the planes of the slits can be vertical.

This latter configuration ensures that a straight line path for contaminants from the guide surfaces through the slits will not be formed and the resulting meandering path will thus further reduce the possibility of escape. As a consequence the probability that all of the contaminants will be captured in the enclosure is greatly increased.

The slits can be provided in the direct vicinity of the traverse so that the legs can have segments lying directly adjacent a wall of the traverse and between this wall of the traverse and a portion or flange of the cover plate which defines with the traverse wall a gap constituting the respective slit.

A further improvement in the clean-room conditions can be obtained utilizing the system of the invention by providing the energy-supply line for each slide within the enclosure, i.e. within the space bounded by the cover plates and passing the conductor through at least one leg of the slide. The energy-supply line can feed an electric motor on the slide which can drive the roll carried between the arms.

A substantially complete covering of the guide surfaces can be achieved when the energy supply line or conductor is constituted as a drag conductor and is received in a box-like portion of the enclosure defined by the cover plates and between the plates of the enclosure and the wall of the traverse.

BRIEF DESCRIPTION OF THE DRAWING

The above and other objects, features and advantages of the present invention will become more readily apparent from the following description, reference being made to the accompanying drawing in which:

FIG. 1 is a partial elevational view of the traverse of a rolling machine provided with slides according to the invention;

FIG. 2 is a section taken along the line II—II of FIG. 1, drawn to a larger scale;

FIG. 3 is a section corresponding generally to FIG. 2 but illustrating another embodiment of the invention; and FIG. 4 is another sectional view similar to FIG. 2 illustrating a third embodiment of the invention.

SPECIFIC DESCRIPTION

FIGS. 1 and 2 show a traverse 1 forming part of a machine of the type described above, e.g. for use in a clean room for winding up magnetic tapes slit from a respective web which may be delivered by a supply roll extending over the total working width of the coiling machine. The traverse 1 likewise extends over the entire width of the coiling machine. The traverse 1 may be of rectangular cross section or some other prismatic shape ensuring that it is stable and free from distortion by torsion or bending under the loads to which it may be subject. A stable torsion-free construction is essential if it is to form a reliable guide.

The traverse is formed along its upper side with two mutually parallel guide rails 2 forming the stationary guide surfaces on which a plurality of slides 3 and 3' can be guided.

Each pair of slides 3 and 3' receive a roll-winding core or coil between them and one of the arms of the pair of slides can be provided with a drive mechanism (not shown) powered by an electric motor 5, a fluid-powered motor or the like.

Roll drives of this type are known in the art and therefore are herein not described in greater detail.

On the slides 3 and 3' there are provided vertically disposed mutually parallel legs 6 each of which has a slide foot 7 riding on a respective one of the rails 2.

The leg 6 and the slide feet 7 form in combination with the respective slides 3, 3', a U-shaped configuration.

Between the guide rails 2 a carrier or support 8 is provided to carry a respective cover plate 9 which extends generally horizontally and reaches to one side of each of the legs 6. In the embodiment of FIGS. 1 and 2, the cover plate 9 practically fills the space between the legs.

The carrier 8 may be a series of posts spaced apart along the traverse.

On both outer sides of the traverse 1, further cover plates 10 are provided which are connected at their lower sides with the traverse 1 and at their upper ends have horizontally extending flanges or portions which have their inner edges juxtaposed with the outer edges of the cover plate 9 and define respective slits between them through which a respective leg 6 passes. The width of each slit corresponds generally to the thickness of the respective leg 6.

It will be apparent, therefore, that the plates 9 and 10 define with the traverse 1 an enclosure which surrounds the guide surfaces formed by the rail 2 and the feet 7 and open to the exterior only through these comparatively narrow slits which correspond in width to the thickness of the legs 6.

These slits are minimal slits and, because they have a substantial spacing from the rails 2, substantially prevent escape of contaminants from the surfaces of these rails.

Indeed, only such contaminants as dust particles and vapor particles which can be formed by the sliding action at the sliding surfaces can escape through the slits to the extent that such particles are directed in a straight-line path from the surfaces through the slits. The probability of such occurrences is very small indeed. The remaining contaminants are collected on and by the inner surfaces of the plates 9 and 10.

The cover plates 10 can define with the traverse 1 a box structure 12 receiving drag lines 13 connected with the motors of the respective slides 3 through the legs thereof and serving as energy feeders for these motors to the drag lines can be conductors for electrical supply to the electric motors or pneumatic or hydraulic lines if the motor is pneumatically or hydraulically energized. Each slide has at least one drag line connected therewith. The energy delivery path through the legs 6 is represented by the line 14 connected to the respective drag line 13 and extending out of a foot 7 of one of the legs 6 of the respective slide and connected to the drive 5.

Thus the drag lines 13 and the energy delivery lines 14 are also within the enclosure formed by the cover plates.

In FIG. 4 there is shown an embodiment of the invention wherein the leg 6 of each slide are mirror-symmetrically offset so as to have horizontally extending segments 15.

The cover plate 9 in this embodiment here has outer edges which extend close to the vertical segments of the leg 6 and overlie the horizontal segments 15 thereof which form the feet 7.

The cover plate 9 has its outer edges coplanar with the inner edges of the horizontal flanges 11 of the cover plates 10. The slits are defined between the outer edges of the cover plate 9 and the inner edges of the flanges 11 and lie in vertical planes. A choice of the particular configuration of the enclosure will depend on local considerations of installation of the apparatus.

FIG. 3 shows a further embodiment of the invention wherein a vertical segment 16 of each leg extends close to a vertical traverse wall 17. The segments 16 thus extend vertically downwardly from the respective feet 7. The cover plate 9 has downwardly turned vertical flanges 91 juxtaposed with the traverse wall 17 to define therewith minimal slits 92 in a horizontal plane directly adjacent the traverse walls 17.

We claim:

1. A coil machine having at least one station adapted to receive a coil of a web, said station comprising:

a traverse;

a pair of rectilinear guides formed on said traverse;

a pair of coil-receiving arms mounted on said guides and receiving a coil of said web between them, said arms each having a coil slide shiftable along said traverse, each of said slides being formed with a respective sliding foot riding on each of said guides and a respective leg formed with each of said feet extending away from the respective foot; and enclosure means extending along said traverse at least around said guides, receiving said feet and at least partly defining slots extending along said guides through which said feet pass for limiting release of contaminants from regions of engagement of said feet with said guides, and said enclosure means including a support mounted on said traverse between said guides and a cover plate on said support at least substantially bridging a space between said legs.

2. The coil machine defined in claim 1 wherein said enclosure means is provided with walls defining said slots and enclosing at least a portion of said traverse provided with said guides.

3. The coil machine defined in claim 1 wherein said enclosure means is provided with walls defining said slots with walls of said traverse.

4. The coil machine defined in claim 1 wherein said slides are of generally U-shaped cross section, said support extending along said traverse and said enclosure means including walls reaching toward outer surfaces of said legs and connected to said traverse.

5. The coil machine defined in claim 4 wherein said traverse is substantially horizontal and said guides are provided on an upper surface of said traverse, said legs being vertical and said slots lying in substantially horizontal planes.

6. The coil machine defined in claim 4 wherein said traverse is substantially horizontal and said guides are provided on an upper surface of said traverse, said legs being inwardly turned and said slots lying in substantially vertical planes.

7. The coil machine defined in claim 1 wherein said traverse is substantially horizontal and is formed with outwardly turned opposite vertical walls, said legs each having a segment extending upwardly along the respective vertical wall to the respective foot, said cover plate overlying said guides and said feet, said cover plate having downwardly turned flanges opposite the respective wall and defining the respective slots therewith.

8. The coil machine defined in claim 1, further comprising an energy-supply line for each of said slides received in said enclosure means and connected to the respective slide through a leg thereof.

9. The coil machine defined in claim 8 wherein each of said energy-supply lines is a drag energy conductor received in a box-like space defined by said enclosure means.

10. The coil machine defined in claim 8 wherein said enclosure means is provided with walls defining said slots and enclosing at least a portion of said traverse provided with said guides.

11. The coil machine defined in claim 8 wherein said enclosure means is provided with walls defining said slots with walls of said traverse.

12. The coil machine defined in claim 8 wherein said slides are of generally U-shaped cross section, said support extending along said traverse and said enclosure means including walls reaching toward outer surfaces of said legs and connected to said traverse.

13. The coil machine defined in claim 12 wherein said traverse is substantially horizontal and said guides are provided on an upper surface of said traverse, said legs being vertical and said slots lying in substantially horizontal planes.

14. The coil machine defined in claim 12 wherein said traverse is substantially horizontal and said guides are provided on an upper surface of said traverse, said legs being inwardly turned and said slots lying in substantially vertical planes.

15. The coil machine defined in claim 8 wherein said traverse is substantially horizontal and is formed with outwardly turned opposite vertical walls, said legs each having a segment extending upwardly along the respective vertical wall to the respective foot, said cover plate overlying said guides and said feet, said cover plate having downwardly turned flanges opposite the respective wall and defining the respective slots therewith.

* * * * *